United States Patent [19]

Rieben et al.

[11] 4,369,662

[45] Jan. 25, 1983

[54] PLUG INSTALLATION APPARATUS

[75] Inventors: Stuart L. Rieben, Pittsburgh; John J. Wilhelm, New Kensington; Mark E. Wylie, Monroeville, all of Pa.

[73] Assignee: Westinghouse Electric Corp., Pittsburgh, Pa.

[21] Appl. No.: 238,260

[22] Filed: Feb. 25, 1981

[51] Int. Cl.[3] ..... G01L 5/00

[52] U.S. Cl. ..... 73/862.01; 29/522 R

[58] Field of Search ..... 73/862.01; 29/715, 726, 29/727, 522, 523

[56] References Cited

U.S. PATENT DOCUMENTS 3,279,301 10/1966 Fischer ..... 29/522 R 3,345,901 10/1967 Brosseit ..... 29/522 R 3,934,325 1/1976 Jaffe ..... 29/523

*Primary Examiner*—Anthony V. Ciarlante

*Attorney, Agent, or Firm*—L. A. DePaul

[57] ABSTRACT

The plug installation apparatus comprises a mechanism for moving an internally captured expander member relative to the shell wherein it is captured thereby expanding the plug into contact with the internal surface of a tube within which the plug is disposed. The apparatus further comprises a sensor mechanism for determining that the plug has been properly inserted in the tube prior to expanding the plug for preventing improper expansion of the plug. The apparatus also comprises force measuring devices for determining and verifying that the proper amount of force has been applied to the expander member.

9 Claims, 8 Drawing Figures

PLUG INSTALLATION APPARATUS

CROSS-REFERENCE TO RELATED APPLICATIONS

This invention is related to copending U.S. patent application Ser. No. 129,538 entitled "Plug Removal Apparatus" filed Mar. 23, 1980 in the name of W. F. Nanstiel et al., to copending U.S. patent application Ser. No. 173,551 entitled "Tube Plug" filed July 30, 1980 in the name of H. D. Kucherer, and to copending U.S. patent application Ser. No. 173,550 entitled "Tube Plug" filed July 30, 1980 in the name of H. D. Kucherer et al., all of which are assigned to the Westinghouse Electric Corporation.

BACKGROUND OF THE INVENTION

This invention relates to plug installation apparatus and more particularly to apparatus for installing plugs in heat exchanger tubes.

In tube-type heat exchangers, a first fluid flows through the tubes of the heat exchanger while a second fluid surrounds the outside of the tubes such that heat exchange occurs between the two fluids. Occasionally, one of the tubes can become defective such that a leak either is impending or occurs therein which allows the two fluids to mingle. When this occurs, it is sometimes necessary to plug the tube so that the fluid does not flow through the tube thereby preventing leakage from the tube.

In nuclear reactor power plants, the tube-type heat exchangers are commonly referred to as steam generators. When a defect occurs in the tubes of the nuclear steam generator that allows the fluid in the tubes to mingle with the fluid outside of the tubes, a more significant problem arises. Not only does this situation create an ineffective heat exchanger, but it also creates a radioactive contamination problem. Since the fluid flowing in the tubes of a nuclear steam generator is generally radioactive, it is important that it not be allowed to leak from the tubes and contaminate the fluid surrounding the tubes. Therefore, when a leak occurs in a nuclear steam generator heat exchange tube, the heat exchange tube is plugged so that the fluid is not permitted to flow through the tube. This prevents contamination of the fluid surrounding the tubes.

There are several kinds of plugs that may be used to plug the heat exchange tubes. One such device used to plug heat exchange tubes in nuclear steam generators is an explosive plugging device. With the explosive plugging devices, a metal plug is inserted in the heat exchange tube with an explosive contained within the plug. When the explosive is detonated, the plug is forced into close contact with the inside of the tube thus blocking flow through the tube. One problem associated with explosive plugging is that should it become necessary to replace the defective tube or a defective plug, the explosive plug must be drilled out which is a time-consuming procedure.

Another device used to plug heat exchange tubes is generally referred to as a mechanical plug. The mechanical plug comprises a cylindrical member closed at one end and having a tapered inner bore. An expander member is disposed in the cylindrical member such that when the expander member is drawn along the longitudinal axis of the cylindrical member, the cylindrical member is forced into close contact with the heat exchange tube due to the relative tapers of the inner surface of the cylindrical member and the expander member. In this type of device, no explosives are necessary to create the close contact between the plug and the heat exchange tube. Rather, the expansion of the plug is caused by the relative movement of the expander member in the plug. This gives the mechanical plug the characteristic of being able to be removed without being drilled out. In order to remove the mechanical plug, it is, thus, first desirable to relieve the internal pressure on the plug by moving the expander member to a position in the plug in which the tapered diameters of the plug and expander member are not in contact. Next, with the pressure on the plug relieved, the plug may then be pulled from the heat exchanger tube.

In order to quickly install a mechanical plug in the heat exchange tube, it is desirable to have a mechanism capable of both inserting the plug in the tube and of quickly moving the expander in the plug so as to lodge the plug in the tube. There are several mechanisms that can be used to accomplish this insertion of the plug in the tube. However, quick insertion of the plug in the tube is not the only criterion to be met in such a procedure. In addition to quickly inserting the plug in the tube, it is also necessary to be able to positively verify that the plug has been properly positioned in the tube prior to expansion of the plug. Improper installation of the plug in the tube can result in an improper seal between the plug and the tube or in damage to the tube. Also, it is important to be able to verify that the plug has been expanded to the proper limit in order to verify that the plug has effectively sealed the tube.

Therefore, what is needed is an improved plug installation apparatus that is capable of quickly installing a plug in a tube and capable of verifying that the plug has been properly installed.

SUMMARY OF THE INVENTION

The plug installation apparatus comprises a mechanism for moving an internally captured expander member relative to the shell of the plug wherein it is captured thereby expanding the plug into contact with the internal surface of a tube within which the plug is disposed. The apparatus further comprises a sensor mechanism for determining that the plug has been properly inserted in the tube prior to expanding the plug for preventing improper expansion of the plug. The apparatus also comprises force measuring devices for determining and verifying that the proper amount of force has been applied to the expander member.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

When a tube becomes defective in a tube-type heat exchanger, it is sometimes desirable to plug the tube to prevent flow through the tube and thus prevent possible leakage from the tube. The invention described herein provides apparatus for installing a plug in a tube to prevent flow through the tube.

Figure 1:
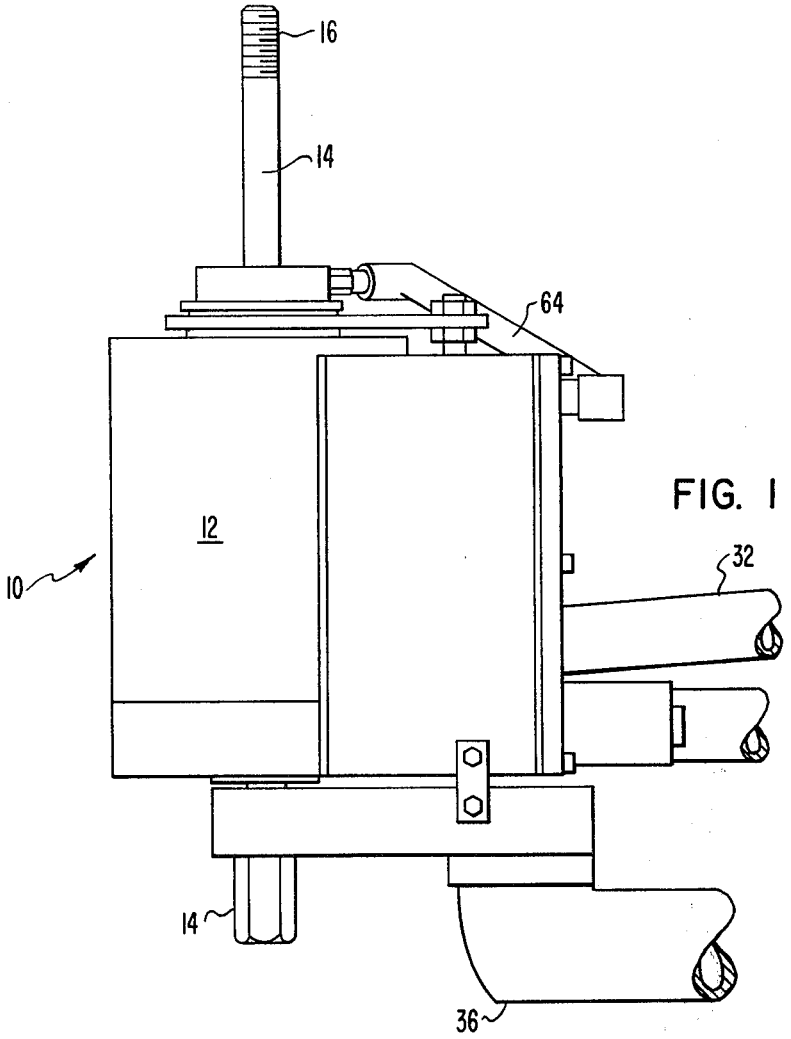
FIG. 1 is a view in elevation of the plug installation apparatus.
Figure 2:
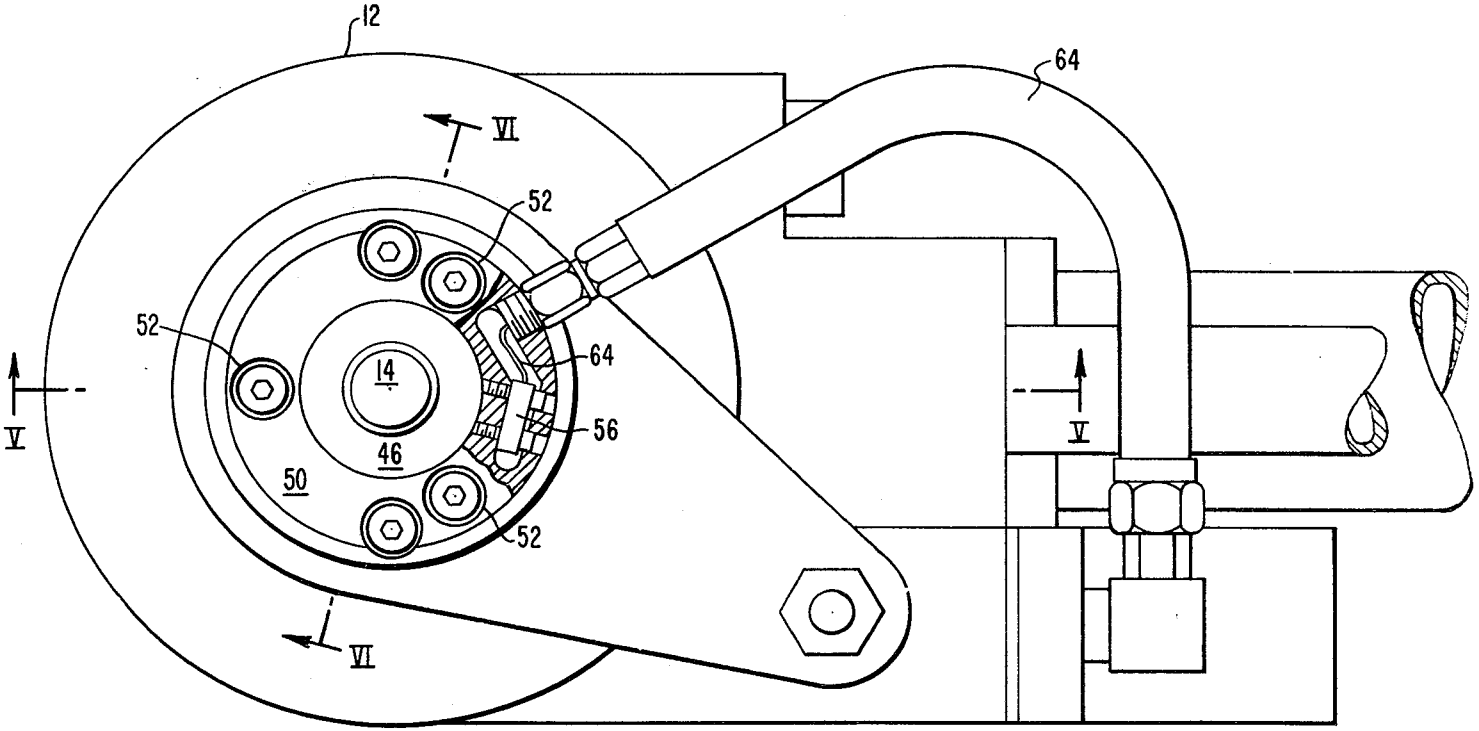
FIG. 2 is a top view of the plug installation apparatus.

Referring to FIGS. 1 and 2, the plug installation apparatus is referred to generally as 10 and comprises a housing 12 with a movable rod 14 disposed therein. Rod 14 has threads 16 on one end thereof for engaging threads in a tube plug.

Figure 3:
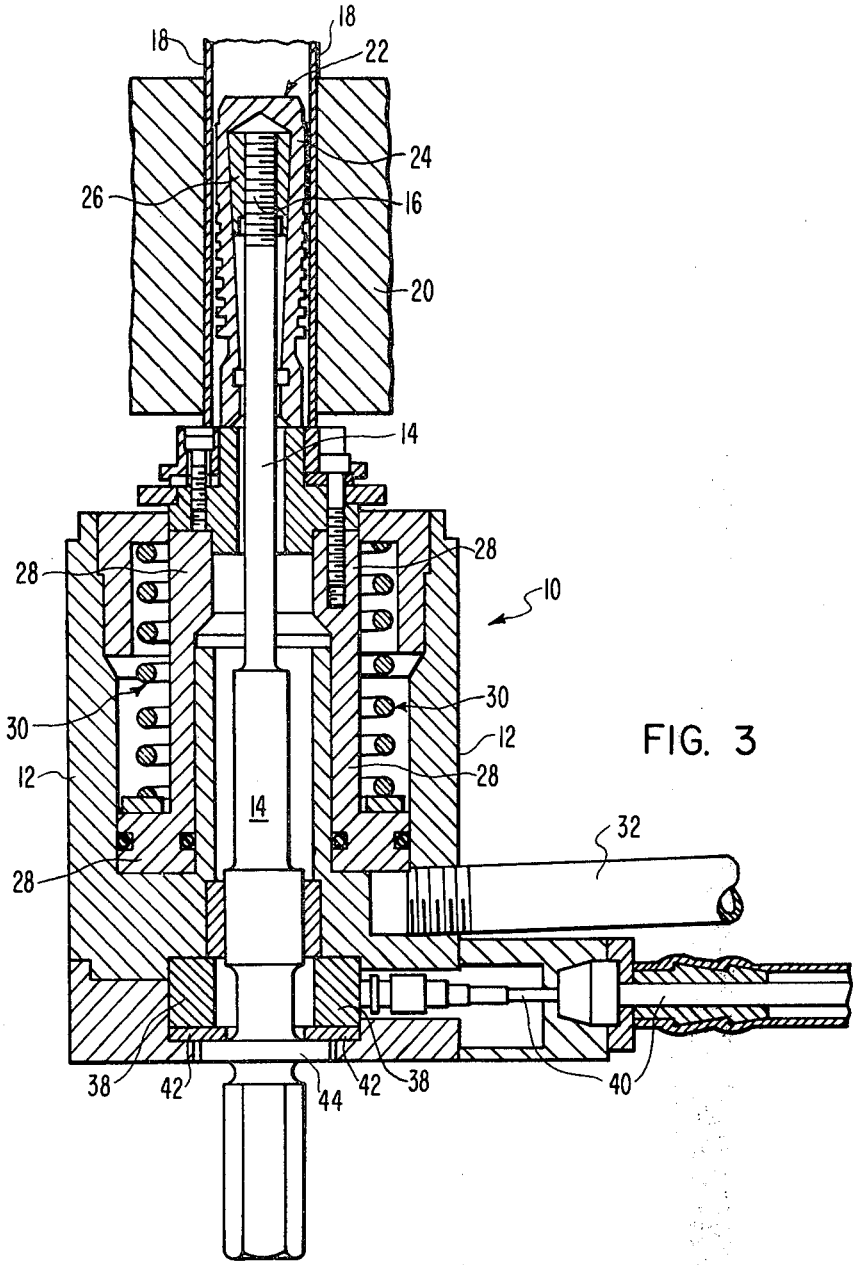
FIG. 3 is a cross-sectional view in elevation of the plug installation apparatus with the plug in the unexpanded position.

Referring now to FIG. 3, a typical heat exchange tube 18 is supported by a tube sheet 20 in a manner similar to those of a nuclear steam generator. When it is desired to prevent flow of a fluid through tube 18 such as when tube 18 has developed a leak therein, a tube plug such as plug 22 may be inserted into tube 18. Plug 22 may be of the type disclosed in copending U.S. patent application Ser. No. 173,551 filed July 30, 1980 in the name of H. D. Kucherer and entitled "Tube Plug" and may comprise a shell 24 and an expander member 26. Shell 24 may be a substantially cylindrical member having a conical inner surface which has a larger diameter at its closed end and a smaller diameter at its open end. Expander member 26 is captured within shell 24 so that movement of expander member 26 relative to shell 24 causes shell 24 to expand without allowing expander member 26 to be removed from shell 24. Expander member 26 may also have an internally threaded bore for engaging threads 16 of rod 14 such that rod 14 may engage expander member 26 for moving expander member 26 relative to shell 24.

Still referring to FIG. 3, plug installation apparatus 10 further comprises a slider member 28 slidably disposed within housing 12 and arranged to accommodate rod 14. A biasing mechanism 30 which may be a coil spring is located in housing 12 and in contact with slider member 28 and serves to urge housing 12 into a configuration as shown in FIG. 3. A first conduit 32 is connected to housing 12 near the lower end of slider member 28 and provides a means to introduce a fluid such as oil into housing 12. First conduit 32 also provides a means to release the same fluid from housing 12. When fluid is introduced into housing 12 through first conduit 32 at a pressure of about 3,000–7,000 psi, housing 12 is caused to move downwardly relative to slider member 28 as shown in FIG. 4.

Figure 4:
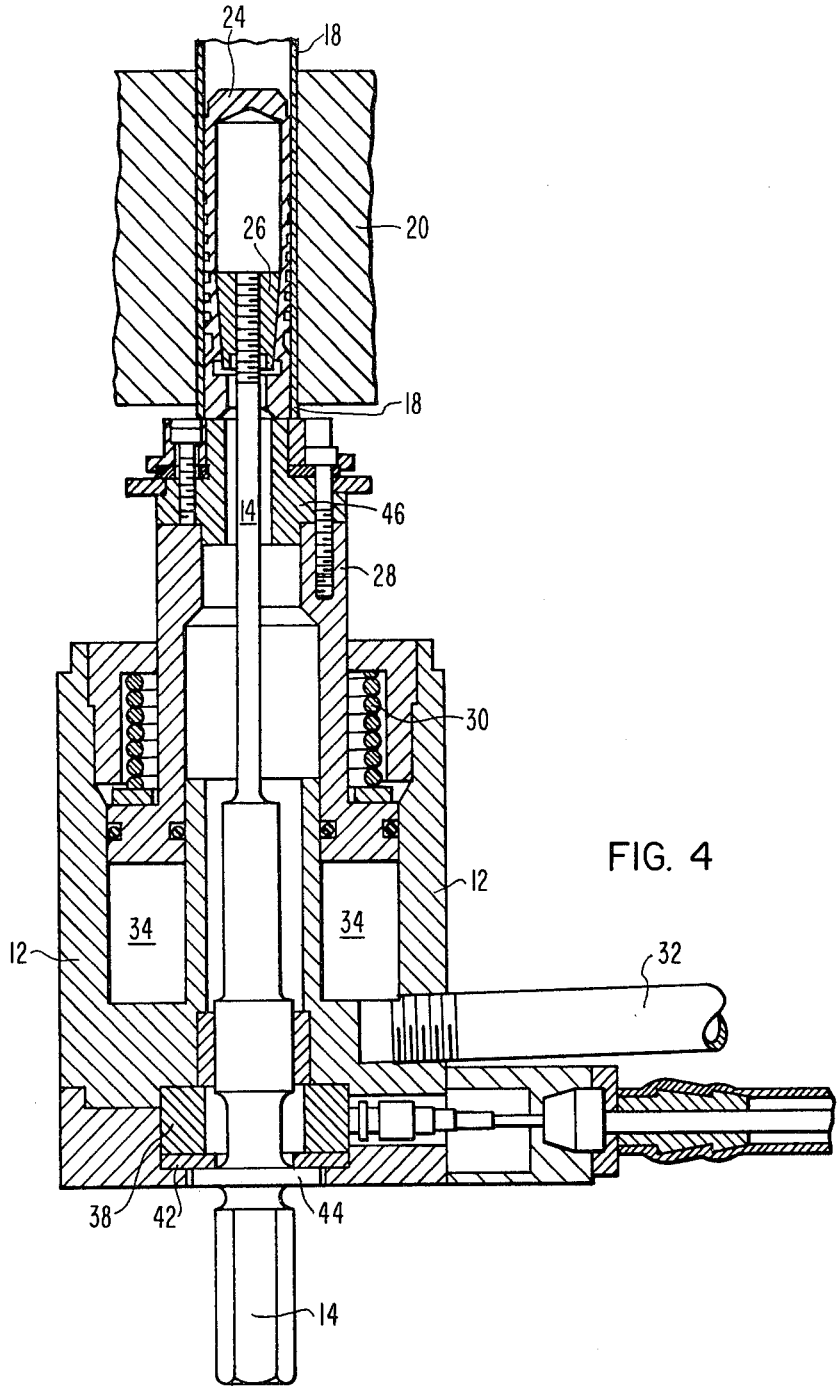
FIG. 4 is a cross-sectional view in elevation of the plug installation apparatus with the plug in the expanded position.

Referring now to FIG. 4, with the fluid introduced under pressure into housing 12 and into annulus 34 defined between slider member 28 and housing 12, housing 12 is moved downwardly and away from tube sheet 20 thereby causing biasing mechanism 30 to be compressed. The fluid is annulus 34 may be released by relieving the pressure in first conduit 32 such as by opening a valve (not shown) in first conduit 32. With the pressure thus released, biasing mechanism 30 will cause housing 12 to move upwardly with respect to slider member 28 thereby returning housing 12 to the configuration shown in FIG. 3.

As shown in FIGS. 3 and 4, rod 14 is not attached to housing 12 or to slider member 28 so that rod 14 may slide and rotate with respect thereto. This allows rod 14 to be able to be threaded into or out of engagement with expander member 26. However, plug installation apparatus 10 may be provided with an automatic drive mechanism 36 as shown in FIG. 1 which is capable of being attached to plug installation apparatus 10 in a manner to engage rod 14 so as to automatically rotate rod 14 with respect to expander member 26. In addition, drive mechanism 36 is capable of holding rod 14 in proper relationship to housing 12.

A force ring 38 which may be a substantially cylindrical piezoelectric device such as model 9041 from the Kistler Instrument Corporation of Grand Island, New York is mounted in housing 12 and around rod 14. Force ring 38 is connected by electrical lines 40 to instrumentation for indicating the force applied on rod 14 by housing 12 which is the same amount of force that is applied on expander member 26 and shell 24 by rod 14. Thus, force ring 38 provides a means to remotely indicate and record the force applied on plug 22 thereby providing a means to verify that plug 22 has been properly expanded in tube 18. A metal load ring 42 is disposed around rod 14, in contact with force ring 38, and attached to housing 12 in a manner to secure force ring 38 to housing 12. Rod 14 has a flange 44 that extends around rod 14 and is located near load ring 42. When housing 12 is forced downwardly by the introduction of a fluid into annulus 34, load ring 42 contacts and transmits the force onto flange 44 of rod 14. At the same time, load ring 42 exerts the same force on force ring 38 which causes force ring 38 to transmit an electrical signal indicating the magnitude of the force. This force is also transmitted by rod 14 to expander member 26 which causes expander member 26 to move downward relative to shell 24 thereby expanding shell 24. Thus, the force on expander member 26 and shell 24 can be determined by monitoring the fluid pressure in annulus 34 and by monitoring the output of force ring 38.

Figure 5:
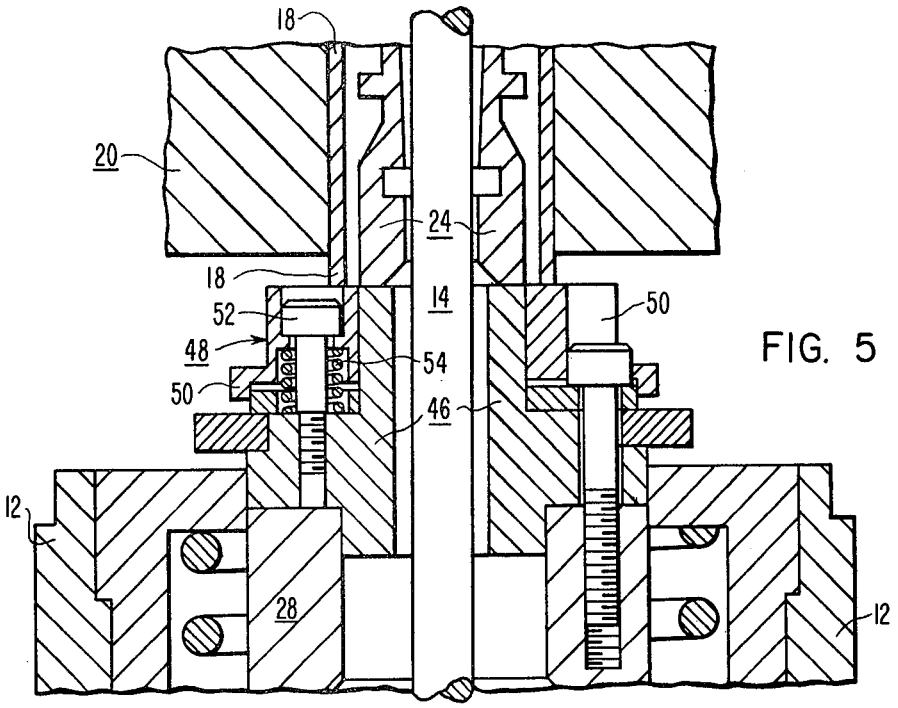
FIG. 5 is a view along line V—V of FIG. 2.
Figure 6:
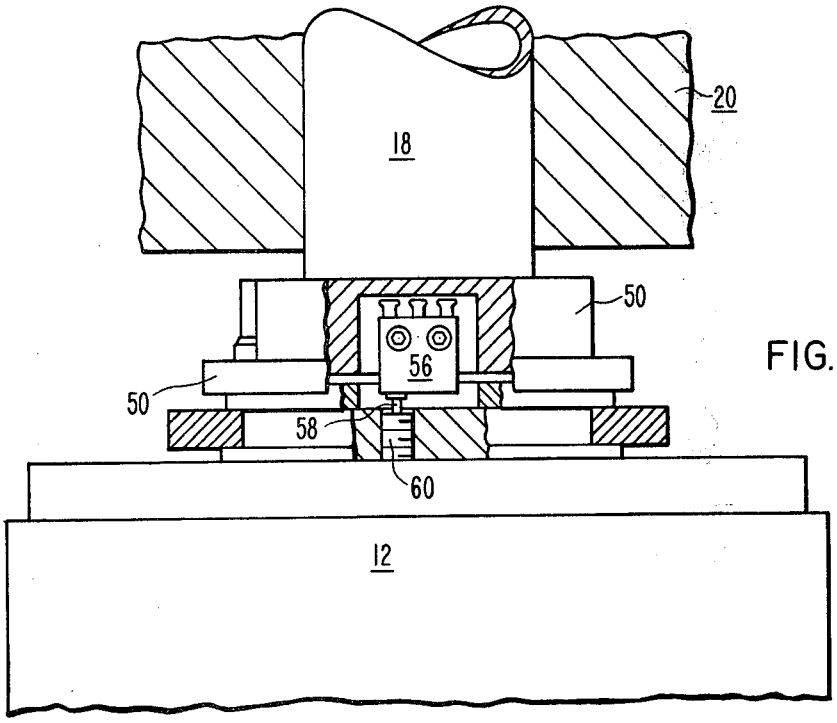
FIG. 6 is a view along line VI—VI of FIG. 2.

Referring now to FIGS. 2, 5 and 6, an end piece 46 is mounted on the top end of slider member 28 by means of bolts or other similar fasteners. End piece 46 is arranged to contact the lower end of shell 24 and serves to hold plug 22 in tube 18 while expander member 26 is moved downwardly by rod 14. In addition, a sensor mechanism 48 is mounted on end piece 46 so as to be able to contact the lower end of tube 18. Sensor mechanism 48 comprises a contact member 50 which may be a metal cover disposed on end piece 46 and around rod 14. Contact member 50 may be held in end piece 46 by a plurality of bolts 52 with each bolt 52 having a coil spring 54 disposed therearound. A switch 56 which may be a Model No. 4901-2100 type switch manufactured by the McGill Manufacturing Company is attached to contact member 50 and has a contact arm 58 that is arranged to contact a recessed screw 60. Screw 60 is recessed in end piece 46 and provides a means to adjust the contact of contact arm 58 with screw 60 by advancing screw 60 in end piece 46. Coil springs 54 urge contact member 50 and switch 56 away from plate 62 but are limited by bolts 52 so that the movement of contact member 58 and switch 56 with respect to screw 60 is limited. This limited movement allows contact arm 58 to contact screw 60 and complete an electrical circuit in switch 56 when contact member 50 contacts the bottom of tube 18 as shown in FIG. 6. Switch 56 is connected to instrumentation located remote therefrom by electrical lines 64 thereby indicating to working personnel that such contact has been made. The arrangement of sensor mechanism 48 with respect to end piece 46 provides a means by which working personnel can remotely positively verify that sensor mechanism 48 is abutting the end of tube 18. With the knowledge that sensor mechanism 48 is abutting the end of tube 18, working personnel located remote from plug installation apparatus 10 can be sure that plug 22 is fully disposed in tube 18 before plug 22 is expanded by remotely activating plug installation apparatus 10. The ability to determine that plug 22 is properly inserted in tube 18 before plug 22 is expanded prevents plug 22 from being expanded when not properly inserted thus preventing damage to tube 18 or preventing faulty installation of plug 22 which might result in a leaky installation. This advantage is particularly valuable when plug installation apparatus 10 is used in a hazardous environment such as in a nuclear steam generator where the radioactive environment limits accessiblity to the work area.

Figure 7:
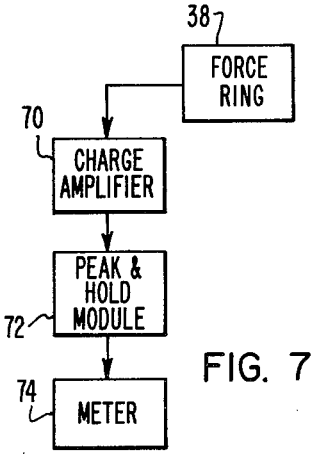
FIG. 7 is a schematic diagram of the force ring instrumentation.

Referring now to FIG. 7, force ring 38 is connected electrically by electrical lines 40 to a charge amplifier 70 which may be a model 504E manufactured by the Kistler Instrument Company. Charge amplifier 70 is connected to a peak and hold module 72 such as a model AP4570-251 by Action Instruments Company and in turn is connected to a meter 74. This instrumentation allows the force exerted on force ring 38 to be converted to a visually readable meter reading so that the operator can verify the force exerted on plug 22.

Figure 8:
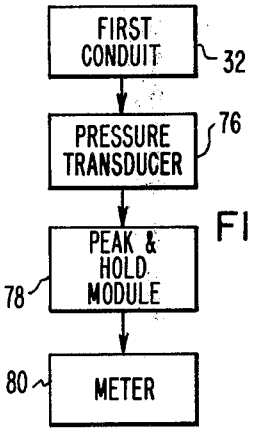
FIG. 8 is a schematic diagram of the pressure instrumentation.

Referring now to FIG. 8, first conduit 32 is connected to a pressure transducer 76 which may be a model 204E manufactured by Setra Systems, Inc. which is connected to a peak and hold meter 78 such as a model AP4570-258 manufactured by Action Instruments Company that is connected to a meter 80. This instrumentation provides a means by which the pressure in first conduit 32 and in annulus 34 can be visually read by an operator or operators. The pressure readings on meter 80 can be used to determine the force exerted on plug 22 by the pressure in annulus 34. Thus by comparing the readings of meter 80 and meter 74, the operator or operators can verify that the proper amount of force has been applied to plug 22 thereby assuring that plug 22 has been properly expanded in tube 18.

In addition, plug installation apparatus 10 may be equipped with instrumentation such as a linear variable differential transformer for indicating the length of travel of expander member 26 with respect to shell 24.

OPERATION

When it is desired to plug a tube in a tube-type heat exchanger such as a nuclear steam generator, a plug such as plug 22 is manually threaded onto threads 16 of rod 14 until the bottom end of plug 22 is in contact with end piece 46. Next the operator inserts rod 14 with plug 22 attached thereto into a tube 18 so that contact member 50 is in contact with the bottom end of tube 18 as shown in FIG. 3. When in this configuration, contact arm 58 of switch 56 will be depressed slightly thereby activating switch 56 which visually or audibly alerts the operator or other working personnel which may be located remote from plug installation apparatus 10 that plug 22 has been properly inserted in tube 18. If contact member 50 does not contact tube 18, switch 56 will not be activated which will indicate to the operator or others that plug 22 should be rearranged with respect to tube 18.

If switch 56 gives a positive indication that plug 22 is properly inserted in tube 18, the operator or others will then cause a fluid such as oil to be introduced through first conduct 32 at a pressure of approximately 3,000–7,000 psi and into annulus 34 which causes housing 12 to move downwardly with respect to tube 18 while the operator or remote equipment supports housing 12. The pressure thus introduced can be read on meter 80 by the operator. The downward movement of housing 12 causes load ring 42 to exert the same force on flange 44 of rod 14. This force is also transmitted to force ring 38 and indicated on meter 74. In this manner, the force exerted on rod 14 by the pressure in annulus 34 can be determined by reading and comparing meter 74 and meter 80 thus verifying the force exerted on rod 14. The force exerted on flange 44 of rod 14 is transmitted to expander member 26 which causes expander member 26 to move downwardly relative to shell 24 because shell 24 is held in place by end piece 46. These movements cause plug 22 to be expanded in and sealed to tube 18 thereby preventing fluid flow through tube 18.

With plug 22 expanded in tube 18, rod 14 may be disengaged from expander member 26 by unthreading rod 14 therefrom. This may be accomplished manually or automatically by drive mechanism 36. When rod 14 has been unthreaded from expander member 26, the plug installation procedure is completed.

Therefore, it can be seen that the invention provides an improved plug installation apparatus that is capable of quickly installing a plug in a tube and capable of verifying that the plug has been properly installed.

We claim as our invention:

1. A plug installation apparatus including a housing with a slider member disposed therein, a rod slidably disposed in said slider member and means for moving said rod relative to said slider member for expanding a plug in a tube, the improvement comprises:

a contact member disposed on said slider member for contacting the end of said tube; and switch means mounted on said contact member and arranged to contact said slider member for indicating that said contact member has been moved relative to said slider member.

2. The plug installation apparatus according to claim 1 wherein said apparatus further comprises:

a plurality of bolts disposed through said contact member and attached to said slider member for loosely holding said contact member to said slider member; and a plurality of coil springs with one of each disposed around one of each of said bolts and between said contact member and said slider member for urging said contact member away from said slider member.

3. The plug installation appartus according to claim 1 wherein the apparatus further comprises force measuring means attached to said housing and capable of contacting said rod when said rod is moved relative to said slider member for determining the magnitude of force exerted on said rod by said housing.

4. The plug installation apparatus according to claim 3 wherein said force measuring means comprises a force ring attached to said housing and around said rod for determining the magnitude of force exerted on said rod by said housing.

5. A plug installation apparatus including a housing with a slider member disposed therein, a rod slidably disposed in said slider member and means for moving said rod relative to said slider member for expanding a plug in a tube, the improvement comprises:

sensor means disposed on said slider member and around said rod for determining that said slider member is in contact with said tube; and force measuring means attached to said housing and capable of contacting said rod when said rod is moved relative to said slider member for determining the magnitude of force exerted on said rod by said housing.

6. The plug installation apparatus according to claim 5 wherein said force measuring means comprises a force ring attached to said housing and around said rod for determining the magnitude of force exerted on said rod by said housing.

7. The plug installation apparatus according to claim 6 wherein said force measuring means further comprises a load ring disposed near said force ring and around said rod for transmitting the force exerted by said housing to said force ring and to said rod.

8. The plug installation apparatus according to claim 7 wherein said force ring comprises a piezoelectric device.

9. The plug installation apparatus according to claim 8 wherein said force measuring means further comprises:

a charge amplifier connected to said force ring for amplifying the charge produced by said force ring when said housing exerts a force on said force ring;

a peak and hold module connected to said charge amplifier for determining and recording the magnitude of the highest force exerted on said force ring; and a meter connected to said peak and hold module for displaying the readings of said peak and hold module.

* * * * *